United States Patent [19]

Maruyama et al.

[11] 4,335,089

[45] Jun. 15, 1982

[54] PROCESS FOR PRODUCING CARBON FIBERS

[75] Inventors: Kunio Maruyama; Akira Okazaki, both of Okayama, Japan

[73] Assignee: Sumitomo Chemical Co., Ltd., Osaka, Japan

[21] Appl. No.: 182,611

[22] Filed: Aug. 29, 1980

[30] Foreign Application Priority Data

Aug. 31, 1979 [JP] Japan ..... 54-112314

[51] Int. Cl.[3] ..... D01F 9/14; D01F 9/22

[52] U.S. Cl. ..... 423/447.4; 264/29.2; 423/447.6

[58] Field of Search ..... 423/447.4, 447.6, 447.1; 264/29.2

[56] References Cited

U.S. PATENT DOCUMENTS 3,533,743 10/1970 Prescott et al. ..... 423/447.6

3,552,923 1/1971 Carpenter et al. ..... 423/447.6

4,186,179 1/1980 Katsuki et al. ..... 423/447.4

FOREIGN PATENT DOCUMENTS 53-23411 7/1978 Japan ..... 423/447.4

*Primary Examiner*—Edward J. Meros

*Attorney, Agent, or Firm*—Wenderoth, Lind & Ponack

[57] ABSTRACT

A method for the continuous production of carbon fibers from two or more cheese-like articles of organic polymer fibers having yarn ends at the top portion and tail portion, characterized by preliminarily heat-treating the yarn ends of each cheese-like article, connecting the tail end of a cheese-like article with the top end of another cheese-like article in such a manner that connecting loop portions and knot portions are disposed at different positions, and thereafter causing the yarn to pass through heat-treating furnaces.

2 Claims, 3 Drawing Figures

PROCESS FOR PRODUCING CARBON FIBERS

Figure 1:
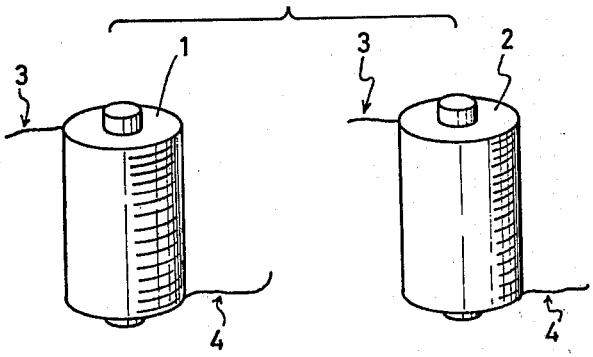

The present invention relates to a method for the continuous production of carbon fibers. More specifically, in producing carbon fibers continuously from two or more cheese-like articles (yarns wound on bobbins or spools or folded up and stored in boxes; hereinafter called cheeses by reason of simplification) so formed that they have yarn ends at two portions, the invention relates to a method of continuous passage of the yarn through heat-treating furnaces, which method comprises preliminarily heat-treating the yarn ends; connecting the tail end (rear end) of a cheese to the top end (front end) of another cheese by a particular method, and thereafter causing the yarn to pass through heat-treating furnaces continuously.

Usually, precursor fibers used for producing carbon fibers are stored or transported in the form of cheeses composed of a prescribed amount of yarn wound on bobbins or spools or in a boxed state. For this reason, in order to perform a continuous heat treatment, it is necessary, on nearly completion of the heat treatment of a cheese, to connect its tail end with the top end of the next cheese. In the heat treatment step, the precursor fibers generate heat under the action of oxidation. But, since at the knot portions, the fiber bundle is compressed densely because of tight fastening, the release of reaction heat cannot be accomplished effectively, which consequently causes accumulation of heat to bring the knot portions to a higher temperature. This results in a more violent oxidation reaction and the knots are brought to still elevated temperatures. Finally, the fiber bundle is fused and broken at the knot portions. In order to avoid such a trouble, a method is employed wherein, during the passage of the knots through the heating furnace, the heat treating temperature is extremely lowered so as to prevent fiber breakage. However, this method causes not only a decrease in productivity but also a loss in heat energy. As a means to avoid such disadvantages, another technique is proposed which is described in Japanese Patent Publication No. 23411/1978. However, in this method, the density of the knots is not made coarse, so that owing to an extraordinary heat generation at the knots during the heat treatment, the fiber bundle is also broken finally.

In such a situation, in order to remedy the abovementioned disadvantages, we studied intensively for obtaining a continuous heat treatment means which will be closely related with high productivity. As a result, we have found that the problems attendant on the conventional methods can be solved by preliminarily heat-treating the yarn ends of the cheeses made of organic polymer fibers, i.e. the starting material, and connecting the yarn ends between said cheeses by a particular connecting method. The present invention is based on this discovery.

The main object of the present invention is therefore to provide a method of producing carbon fibers continuously and efficiently by connecting discontinuous cheeses of organic polymer fibers.

An object of the invention is to provide a method of producing carbon fibers wherein a loss in the heat energy required for heat treatment is prevented.

Other objects of this invention will become apparent from the following detailed explanation which will be made by referring partly to the accompanying drawings wherein FIG. 1 is a schematic view of a cheese-like package to be used in this invention, and FIGS. 2(*a*) and 2(*b*) are explanatory views for illustrating the manner of connecting yarn ends.

In a method wherein carbon fibers are produced continuously from two or more cheeses of organic polymer fibers having yarn ends at the top portion and tail portion, the above-mentioned objects are attained by preliminarily heat-treating the yarn ends of each cheese; connecting a yarn end (tail end) of a cheese with a yarn end (top end) of another cheese in such a manner that connecting loop portions and knot portions are disposed at different positions; and thereafter causing the yarn to pass through the heat-treating furnaces.

What is important to attain the objects of the present invention is the combination consisting of preliminarily heat-treating the yarn ends of the cheeses, taking the thus heat-treated yarn ends as the places for forming knots; and connecting the heat-treated yarn end of a cheese with that of another cheese in such a manner that connecting loop portions and knot portions are disposed at different positions.

FIG. 1 is a schematic illustration of such cheeses. Each of the cheeses 1 and 2 is furnished with a top end 3 and a tail end 4. Upon continuous heat treatment, the tail end 4 of the cheese 1 is connected with the top end 3 of the cheese 2. FIGS. 2(*a*) and 2(*b*) illustrate examples of the manner of connecting yarn ends; FIG. 2(*a*) shows the top end 3 and the tail end 4 before they are connected, and FIG. 2(*b*) shows how the top end 3 and the tail end 4 are connected after they are respectively divided into two portions. In FIG. 2(*b*), the yarn ends are connected in such a manner that the connecting loop portions 5 and the knot portions 6 are disposed at different positions.

As previously mentioned, in the present invention, the combination consisting of the preliminary heat treatment of yarn ends and the particular connecting method is important. In the following, a more detailed explanation will be given about this matter.

Firstly as regards the preliminary heat treatment of yarn ends, a certain number of cheeses consisting of yarns wound on bobbins, etc. or folded regularly in boxed in such a manner that the top and tail ends of the yarn stick out, are prepared, and only the yarn ends are treated batchwise. The batch treatment condition is not particularly limited, and there can be employed a heat treatment at 200°–300° C. in air, ozone, or other oxidizing atmospheres or followed by a further heat treatment at 300°–700° C. in a non-oxidizing atmosphere. This preliminary heat treatment is indispensable in that, in the subsequent heat treatment, the reaction heat at the knot portions can be released sufficiently to prevent the fusion and breakage of the precursor fibers. In other words, even if the particular connecting method is employed, so far as yarns whose yarn ends have not been subjected to the preliminary heat treatment are used, the objects of the present invention are not attained. In order to carry out the subsequent continuous heat treatments more efficiently, the preliminary heat treatment should be performed under suitably selected heat treatment conditions so that the end yarn will have an elongation of 5% or more, a tensile strength of 1 g/d or more, and a specific gravity of 1.30 to 1.45. If the elongation and tensile strength are less than the above limits, there may be caused a disadvantage that the knot portions are partly broken in the thermal stabilization step and the carbonization step, and if the specific gravity is less than 1.30 or exceeds 1.45, partial breakage of knot portions may be also caused.

Figure 2A:
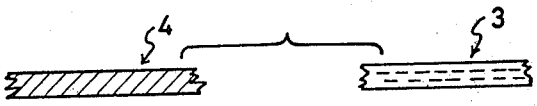
Figure 2B:
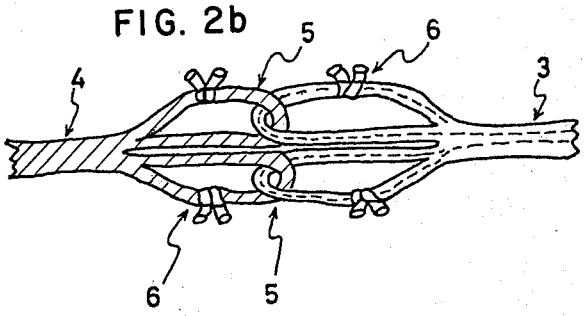

In the next place, the connection of yarn ends is carried out, for example as in FIG. 2(*b*) as previously mentioned. Such a connection method is, of course, applicable even for connecting a single filament with another single filament, but among others, it is employed in the case where the total number of the filaments composing the precursor is about 4000 or more. When the total number of filaments is 4000 or more, the divided filament bundles are connected with each other as shown in FIG. 2(*b*), so that the density of the knot portions become coarse, which is effective for the release of reaction heat. Explaining more concretely, we assume that the top end (3) and the tail end (4) of the yarn in FIG. 2(*a*) are both composed of 6,000 filaments, and these are divided into two portions so that each one portion will be composed of 3000 filaments. The top end and the tail end thus divided into two portions are connected with each other in such a manner that the loop portions (5) and knot portions (6) are disposed at different positions.

The particular method of connection according to the present invention forms the knots into a coarse structure in density to suppress the extraordinary heat generation at the knot portions in the course of the heat treatment (though the number of knots are increased). Therefore, when a precursor composed of a large number of filaments is used, it is advantageous to divide filament bundles and connect the divided filament bundles with each other. In such a case, it is desirable that the number of filaments of the divided filament bundle should be about 1000 to 3000 filaments. Of course, it is sufficient to divide filament bundles only in the vicinity of the portions where knots will be formed (yarn ends), and it is not necessary to divide filament bundles throughout their whole length contained in cheeses.

As for the method of forming knots, the knots should be preferably formed as small as possible as double true knots which are difficult to loosen. However, suitable methods are not limited to such.

Among the organic polymer fibers to be used in the present invention, acrylonitrile fibers are preferred, but cellulosic fibers, polyamide fibers, pitch fibers, etc. may be used.

The precursor fibers on which knots have been formed by the method of the present invention are formed into carbon fibers under the usual thermal stabilization and carbonization conditions.

By employing the method of the present invention, it has become possible to produce high-quality carbon fibers efficiently and continuously without lowering the temperature of the heat treating furnaces or stopping the heat treatment operation for a while, even from discontinuous precursor cheeses composed of filaments wound on bobbins, etc. Accompanied with such an advantage, it has become possible to suppress, to a great extent, the heat energy loss upon the heat treatment.

The contents of the present invention will be explained hereunder more concretely by way of examples.

EXAMPLE 1

An acrylonitrile fiber bundle composed of 6000 filaments in total (8000 deniers in total) was wound up on bobbins to produce three cheeses A, B and C. Upon this winding, one-meter lengths of each of the cheeses were taken as the top end portion and the tail end portion.

The six end portions of the three cheeses were subjected to a preliminary heat treatment at 255° C. for 30 minutes. As regards the physical properties of the heat-treated yarns, the tensile strength was 2.2 g/d, the elongation was 13.2%, and the specific gravity was 1.33.

Thereafter, the tail end portion of the cheese A and the top end portion of the cheese B, and the tail end portion of the cheese B and the top end portion of the cheese C were connected so as to form double true knots as shown in FIG. 2(*b*), and the thus-connected yarns were caused to pass continuously through heat-treating furnaces (thermal stabilization and carbonization furnaces). Upon this connection, the end portions of the yarn of each cheese were divided into two portions so that one of the two divided portions is composed of 3000 filaments.

The operation in the heat treatment furnaces proceeded without problems, and there was no breakage of the precursor yarn due to the extraordinary heat accumulation at knot portions.

As a comparative example, the same method as above was employed to cause the yarn to pass through the heat-treating furnaces, except that the yarn ends were not subjected to the above-mentioned preliminary heat treatment (255° C.×30 min.). But the precursor yarn was broken in the thermal stabilization furnace, and therefore the yarn could not be put into the carbonization step. As regards the physical properties of the precursor fibers which were not subjected to the preliminary heat treatment, the elongation was 13.9%, the strength was 6.9 g/d, and the specific gravity was 1.18.

EXAMPLE 2

Four kinds of acrylonitrile fiber bundles: the first one composed of 3000 filaments in total (4000 deniers in total), the second one composed of 6000 filaments in total (8000 deniers in total), the third one composed of 12,000 filaments in total (16,000 deniers in total) and the fourth one composed of 40,000 filaments in total (60,000 deniers in total), were respectively wound up on bobbins to prepare, for each fiber bundle, three cheeses A, B, and C. The same lengths as in Example 1 were taken as the end portions.

Then the end portions of the yarn of each cheese were subjected to a preliminary heat treatment at 245° C. for 60 minutes. In this case, the physical properties of the respective heat-treated yarns were as shown in Table 1.

Thereafter, the tail end portion of the cheese A and the top end portion of the cheese B; and the tail end portion of the cheese B and the top end portion of the cheese C were connected so that double true knots were formed as shown in FIG. 2(*b*), and the thus-connected yarns were caused to pass continuously through heat-treating furnaces (thermal stabilization and carbonization furnaces). Upon this connection, the end portions of the yarn of each cheese were divided as shown in Table 1.

The operability in the heat treatment furnaces are also shown in Table 1.

TABLE 1

| Number of filaments | Physical properties of the yarn after the preliminary heat treatment: Elongation (%) | Tensile strength (g/d) | Specific gravity | Division | Operability in in the heat treatments (Passage condition of the knots through the furnaces) |
|---|---|---|---|---|---|
| 3,000 | 15.1 | 2.9 | 1.34 | No | No problem |
| 6,000 | 15.3 | 2.9 | 1.34 | 2 portions | No problem |
| 12,000 | 16.5 | 2.8 | 1.34 | No | Partial breakage sometimes |
| | | | | 4 portions | No problem |
| 40,000 | 17.1 | 2.2 | 1.34 | No | Breakage sometimes |
| | | | | 4 portions | Partial breakage sometimes |
| | | | | 20 portions | No problem |

EXAMPLE 3

Except that the preliminary heat treatment conditions for the end portions of the yarns of the three cheeses used in Example 1 were varied as in Table 2, the yarns of the three cheeses were caused to pass continuously through the heat treatment furnaces according to the same method as in Example 1. The physical properties of the preliminarily heat-treated yarns corresponding their treating conditions and their operability in the heat treatment furnaces are also described in Table 2.

Among the cheeses shown in Table 2, the yarn end portions of some of those subjected to preliminary heat treatment under the conditions of 240° C.×90 minutes) were connected to form mere double true knots without employing the connecting method as shown in FIG. 2(*b*). Upon the passage of such yarns through the heat treatment furnaces, filament breakage occurred owing to the extraordinary heat accumulation at the knot portions, so that the operation did not proceed satisfactorily.

From the results in Table 2, it is understood that when the preliminarily heat treated yarns having the physical properties recommended in the present invention are used, the operability in the heat treatments can be further improved.

TABLE 2

| Preliminary heat treatment condition | Physical properties of preliminarily heat treated yarns: Elongation (%) | Tensile strength (g/d) | Specific gravity | Operability in the heat treatments (Passage condition of the knot portions through the furnaces) |
|---|---|---|---|---|
| 240° C. × 45 min. | 17.5 | 3.5 | 1.29 | Partial breakage sometimes in the thermal stabilization step |
| 240° C. × 60 min. | 16.5 | 3.1 | 1.31 | No problem |
| 240° C. × 90 min. | 15.3 | 2.9 | 1.33 | No problem |
| 255° C. × 90 min. | 11.4 | 1.8 | 1.39 | No problem |
| 270° C. × 30 min. | 11.2 | 0.9 | 1.41 | Partial breakage in the thermal stabilization and carbonization steps |
| 240° C. × 90 min. 300° C. → 500° C. Heating Rate 200° C./min. | 6.5 | 2.8 | 1.44 | No problem |
| 240° C. × 90 min. 300° C. → 600° C. Heating Rate 300° C./min. | 3.9 | 3.3 | 1.46 | Partial breakage in the thermal stabilization and carbonization steps |
| 240° C. × 90 min. 300° C. → 1000°C. Heating Rate 700° C./min. | 1.8 | 10 | 1.65 | Partial breakage in the thermal stabilization and carbonization steps |
| 240° C. × 90 min. 300° C. → 1300° C. Heating Rate 1000° C./min. | 1.3 | 15 | 1.76 | Partial breakage in the thermal stabilization and carbonization steps |

What we claim is:

1. A method for the continuous production of carbon fibers from two or more cheese-like articles of organic polymer fibers having yarn ends at the top portion and tail portion, characterized by preliminarily heat-treating the yarn ends of each cheese-like article so that said yarn end portions have a elongation of 5% or more, a tensile strength of 1 gram/denier or more, and a specific gravity of 1.30 to 1.45; connecting the tail end of a cheese-like article with the top end of another cheese-like article in such a manner that the tail and top ends are divided into at least two portions and connected in the form of loop portions and knot portions, said loop portions and knot portions being disposed at different positions; and thereafter causing the yarn to pass through heat-treating furnaces.

2. The method as claimed in claim 1 wherein said organic polymer fibers are polyacrylonitrile fibers.

* * * * *